United States Patent [19]

Cooney

[11] 4,160,554

[45] Jul. 10, 1979

[54] SKATEBOARD ACCESSORY

[75] Inventor: Robert M. Cooney, Fullerton, Calif.

[73] Assignee: Apollo Spinner, Inc., Los Angeles, Calif.

[21] Appl. No.: 833,182

[22] Filed: Sep. 14, 1977

[51] Int. Cl.[2] ..... B62K 9/00

[52] U.S. Cl. ..... 280/87.04 A; 308/227

[58] Field of Search ..... 280/87.01 R, 87.04 A, 280/87.04 R, 11.3, 607; 308/227, 219; 272/146

[56] References Cited

U.S. PATENT DOCUMENTS

| | | | |
|---|---|---|---|
| 1,884,281 | 10/1932 | Schibrowski | 280/87.01 X |
| 2,779,642 | 1/1957 | Matthews | 272/146 X |
| 3,399,904 | 9/1968 | Schinke | 280/47.16 X |
| 3,522,953 | 8/1970 | Gold | 280/87.04 R |
| 3,771,811 | 11/1973 | Bueno | 280/87.04 R |

FOREIGN PATENT DOCUMENTS

| | | | |
|---|---|---|---|
| 1075477 | 7/1957 | Fed. Rep. of Germany | 280/87.04 R |

*Primary Examiner*—Joseph F. Peters, Jr.
*Assistant Examiner*—R. Schrecengost
*Attorney, Agent, or Firm*—Blakely, Sokoloff, Taylor & Zafman

[57] ABSTRACT

A skateboard accessory is disclosed comprising a rotatable platform coupled to a bearing, which bearing is in turn mounted onto a conventional skateboard. The platform is fully rotatable about an axis perpendicular to the skateboard so that the skateboard rider may twist and rotate while operating the skateboard, thereby allowing the skateboard operator to maximize his skill. The device includes a mounting apparatus for bolting the platform to skateboards without modification.

20 Claims, 5 Drawing Figures

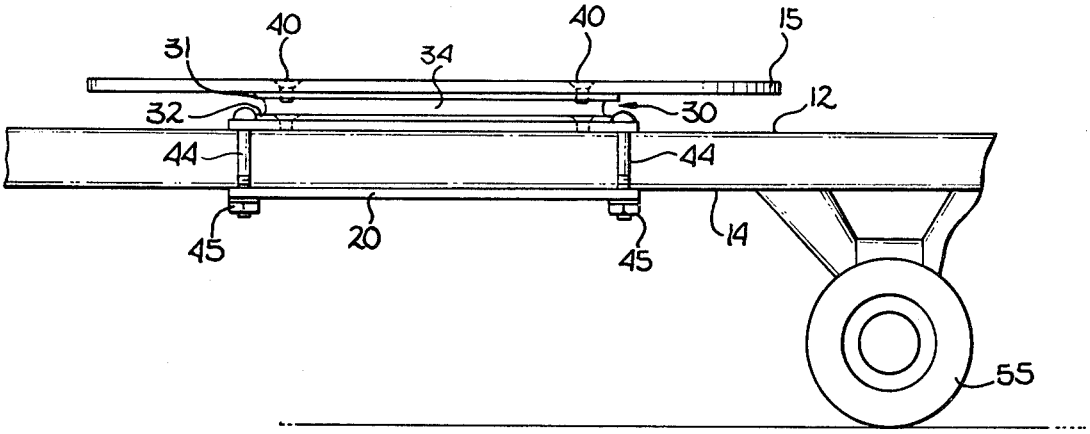
Fig. 3
Fig. 4
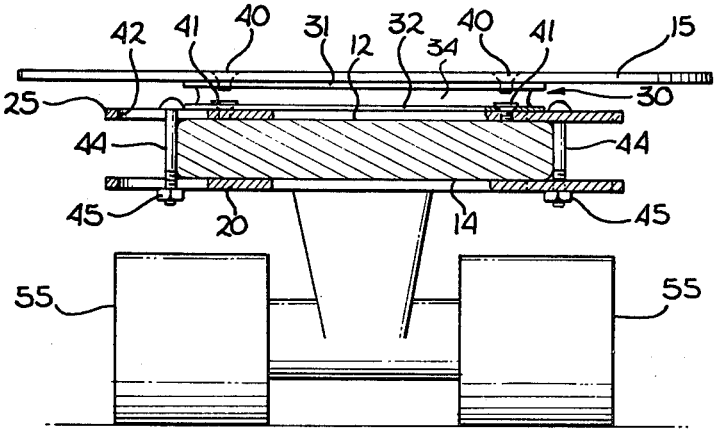
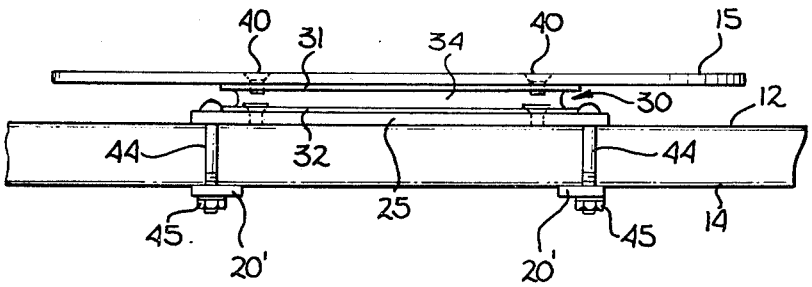
Fig. 5

SKATEBOARD ACCESSORY

BACKGROUND OF THE INVENTION

1. Field of the Invention

The present invention relates to the field of accessories for skateboards, and in particular to platforms attached to the skateboard.

2. Prior Art

Skateboards are in widespread use by children and young persons as a source of amusement and as a sporting activity which requires a considerable amount of skill. In general these devices comprise a footboard on which the operator stands, and rollers affixed to the footboard on which the footboard may roll. These devices have become increasingly used as a source of sporting activity, in which a considerable amount of acrobatic expertise is developed and demonstrated by the operator performing various maneuvers thereon. Various modifications and improvements have been made to the conventional skateboard to allow the operator to develop his skill. For example, U.S. Pat. No. 3,992,025 discloses a skateboard having modified and improved wheels allowing the skateboard to be turned in a shorter turning radius. In general the conventional skateboard is steered by the operator leaning to one side or the other and shifting the weight from one side to the other and from one end of the skateboard to the other, the wheels being somewhat responsive to the changing of the balance of the operator. U.S. Pat. No. 3,771,811 discloses a skateboard-like coaster having an elevated rigid platform for supporting one foot and providing steering capabilities by merely turning the platform one way or the other, as the platform is coupled to the axle of one set of wheels. Finally, U.S. Pat. No. 3,399,904 discloses a skateboard structure wherein a pair of wheels are centrally mounted and a plurality of casters are disposed around the periphery of the skateboard element, thereby allowing the board to be turned and spun by the operator. The device is not one, however, on which the operator may coast and spin at the same time.

Each of these patents discloses improvements and modifications to a skateboard which increases the responsiveness to the operator and requires the operator to develop additional skills to operate properly. However, these devices require permanent modifications to the existing skateboard, and indeed, would require the operator to purchase a new, modified or improved skateboard incorporating these modifications after he learns the basic technique of skateboard-riding on a conventional skateboard. None of the devices shown allows the simple addition of an accessory to an existing skateboard to allow the operator to make the maximum utilization of his operating skill.

SUMMARY OF THE INVENTION

The present invention relates to a skateboard accessory comprising a disc-like platform coupled to a bearing member, which bearing member is in turn fastened to a mounting apparatus for mounting the accessory to a standard skateboard. The disc member is of sufficient size to allow the operator to rest both feet upon it and perform a spinning or a turning maneuver while the skateboard is in operation. The platform is fully rotatable, and provides additional leverage for the operator to turn the entire skateboard and in general allows acrobatic maneuvers of greatly increased complexity. The mounting apparatus comprises a pair of plates, one each of which is disposed adjacent the upper and lower surfaces of the footboard of the skateboard and then bolted together to mount the accessory in place. The plates are provided with slots in which the bolts extend so that the mount is adaptable to footboards of various sizes. In an alternative embodiment, the mounting apparatus comprises an upper plate and a pair of straps disposed transversely to the footboard.

BRIEF DESCRIPTION OF THE DRAWINGS

FIG. 3 is a partial cross-sectional view of the subject accessory and skateboard taken along line 3—3 of FIG. 2.

FIG. 4 is a cross-sectional view taken along line 4—4 of FIG. 2.

FIG. 5 is a side view of an alternative embodiment of the skateboard accessory.

DETAILED DESCRIPTION OF THE INVENTION

Figure 1:
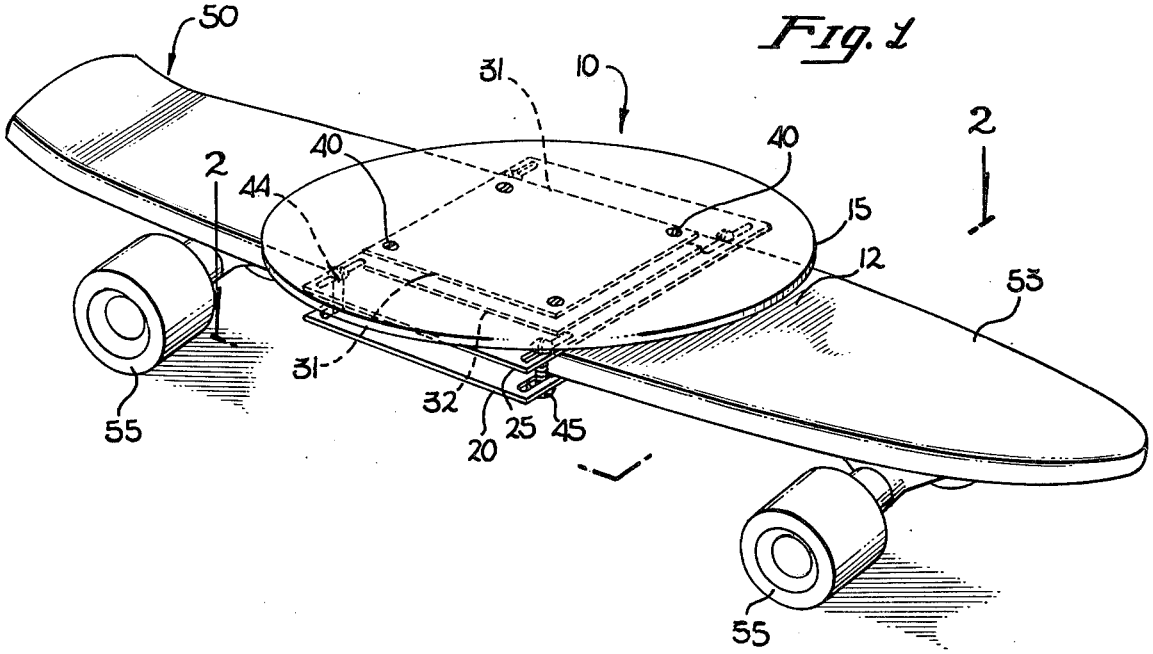
FIG. 1 is a plan view of a skateboard on which the subject accessory is mounted.

Referring now to FIG. 1, the preferred embodiment of the subject invention is shown, in place on a skateboard. As will be more fully described hereinbelow, the accessory is adapted for attachment to standard skateboards which are in widespread use today. As shown in FIG. 1, these skateboards 50 comprise generally a flat, elongated footboard member 53, to which are attached at least two sets of wheels 55. The board 53 is typically wood, metal or fiberglass, and is sized and porportioned to allow the skateboard operator to place his feet on the footboard 53 while coasting and riding the skateboard.

The subject invention comprises generally (i) a platform member (ii) a mounting apparatus for mounting the accessory to a skateboard, and (iii) a bearing member coupling the platform to the mounting apparatus so that the platform is rotatable with respect to the mounting platform, and therefore the skateboard to which the accessory is mounted. The platform member is preferably shaped in the form of a disc. This configuration is desirable inasmuch as the circular platform presents the same platform area to the operator regardless of the angular disposition of the platform. Of course, the platform could be shaped in other configurations, as for example, elongated, but the operator would then have to properly position the platform prior to or simultaneously with mounting the skateboard. The ease of such alignment would be greatly facilitated by practice and operator skill, so that this disadvantage would perhaps be of minimal importance to a skilled operator. The use of an elongated platform member would have the advantage of allowing increased leverage to be applied to tilt the skateboard while turning, and of course, the rotatable aspect of the platform would allow the operator to swivel while riding.

The platform member may be fabricated from a rigid plastic, wood, metal, or other durable rigid material capable of withstanding the stresses inherent in skateboarding. The thickness of the platform is determined by the material used; it is necessary that the platform have sufficient strength for safe operation, and also be attachable to the bearing means by conventional fasteners, such as screws.

Figure 2:
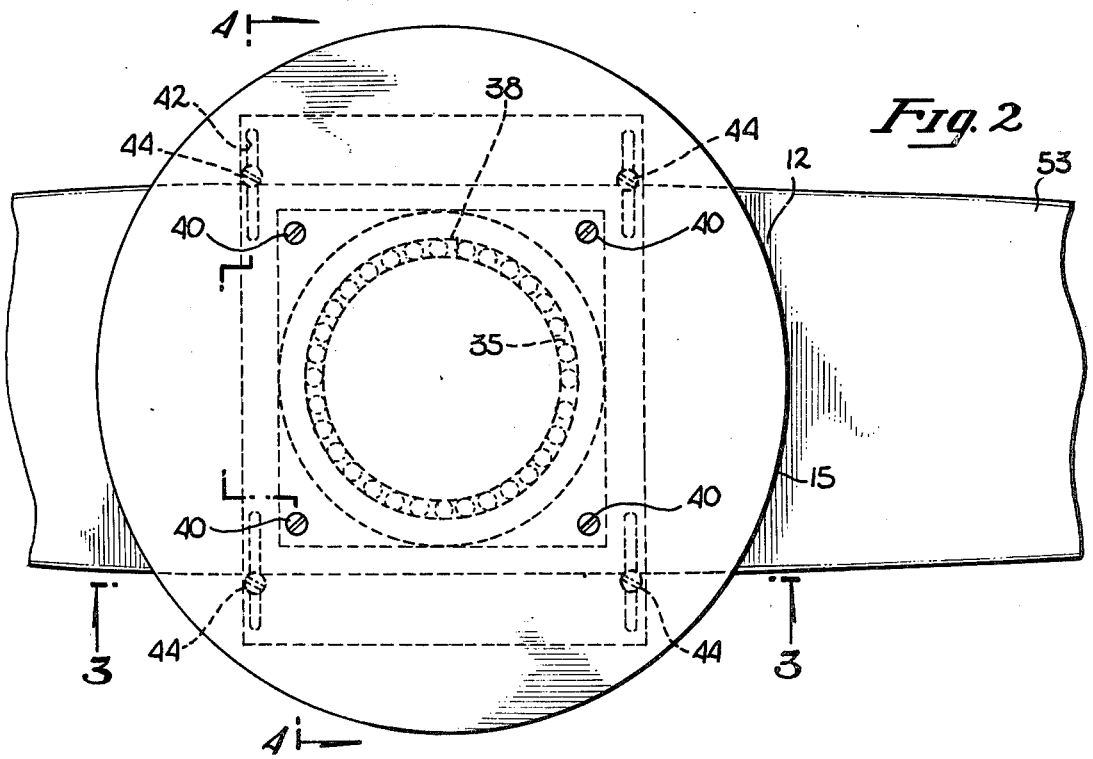
FIG. 2 is a top view of the subject accessory mounted on a skateboard.

Referring now to FIGS. 2 and 3, the bearing member 30 providing the rotatability of the platform 15 will be described. Upper flat surface 31 and lower flat surface 32 are disposed in a parallel, spaced-apart relationship. These surfaces are separated by a plurality of ball bearings 35 constrained in circular ball race 38 (shown in phantom in FIG. 2). As is well-known in the art, a circular ball retainer 34 is disposed adjacent the outer periphery of the ball race 38 (best shown in FIGS. 3 and 4). Upper surface 31 and lower surface 32 are formed together to prevent loss of bearing balls 35 when the accessory is tipped or subjected to stresses tending to separate the surfaces 31 and 32. Therefore, the upper surface 31 contacts the balls 35 and is freely rotatable with respect to lower surface 32, due to the rolling action of balls 35 in race 38. In the embodiments shown in the FIGURES, surfaces 31 and 32 are planar, rectangular members (shown in phantom in FIGS. 1 and 2). Upper surface 31 is secured by screws 40 to the underside of platform 15 such that the axis of the platform is generally aligned with the axis of rotation of upper surface 31 relative to lower surface 32.

The mounting apparatus for mounting the accessory to the skateboard comprises upper plate 25 and lower plate 20, and fastening bolts 44 and corresponding nuts 45. As is shown in FIG. 4, upper plate 25 is disposed adjacent the upper surface 12 of footboard 53, and lower plate 20 is disposed adjacent lower surface 14 of footboard 53. Portions of these plates overlap the footboard 53. The upper and lower plates are secured in position by bolt means 44, which are inserted through corresponding slots 42, disposed in the overlapping portions of plates 20 and 25 transversely to platform 15. Slots 42 allow bolts 44 to be positioned to accommodate footboards of varying widths.

An alternate embodiment of the mounting apparatus is shown in FIG. 5. In this embodiment, lower plate 20 is replaced with a pair of strap members 20', disposed transversely to the footboard 53. The end portions of each strap member 20' overlap the footboard 53, and has slots formed therein to receive bolt means 44. The use of strap means 20' results in an accessory of lower weight and lower manufacturing cost.

Lower surface 32 of bearing 30 is attached to upper plate 25 by screws 41, or, alternatively by other conventional fastening means, as by welding.

To mount the accessory 10 to a skateboard, bolts 44 are removed, the upper and lower plates 25 and 20 of the mounting apparatus are disposed in the desired positions adjacent the top and bottom surfaces of the footboard 53, and bolts 44 tightened in place by nuts 45. Alternatively, of course, it would be possible to remove only one pair of bolts 44, loosening the other pair, slide the plates 25 and 20 into position, and then replace the removed pair of bolts and tighten down all nuts 45.

The accessory may be mounted at a wide range of positions on the footboard, in accordance with the desires and requirements of the skateboard operator. While it is expected that most operators would mount the accessory so that the axis of platform 15 is centrally located on the footboard to provide balance, of course, some riders may wish to offset the platform 15 with respect to the board 53; the disclosed apparatus allows the operator this flexibility.

Once the accessory is mounted, the skateboard with accessory is ready for operation. Platform 15 is fully rotatable through 360°, so that the operator may spin while coasting the skateboard. Also, the accessory allows the operator to turn by leaning, the extra width of platform 15 providing increased leverage so that turning may be facilitated. It may be seen that the disclosed accessory adds another dimension to skateboard operation allowing the operator to develop his riding skills to the utmost and allowing spinning maneuvers simultaneously with coasting or turning.

There has been described herein the preferred embodiment of the present invention. It is to be noted, however, that alternative embodiments may be readily fabricated by one skilled in the art. For example, the platform may be integrally fabricated with a footboard, if the removability feature of the accessory is not required. Thus, while the preferred embodiment of the present invention has been disclosed herein, various changes in form and detail may be made therein without departing from the spirit and scope of the invention.

I claim:

1. A skateboard accessory for coupling to the footboard of a skateboard, which comprises:
   - a platform member adapted to support both feet of the skateboard operator;
   - bearing means coupled to said platform member;
   - mounting means for coupling said bearing means to said footboard, said mounting means being adjustable for coupling to footboards of varying thickness and width, said bearing means and said mounting means adapted to allow rotation of said platform member through 360° with respect to said footboard;
   - whereby said platform member is rotatable with respect to said skateboard.

2. The accessory of claim 1 wherein said bearing means has a lower surface for coupling to said footboard, and an upper surface for coupling to said platform, said upper surface rotatable with respect to said lower surface about an axis.

3. The accessory of claim 2 wherein said platform member is a flat disc-like member coupled to said upper surface of said bearing means, the axis of said disc-like member in general alignment with said axis of rotation of said upper bearing surface.

4. The accessory of claim 1 wherein said platform member is disposed generally parallel to the flat surface of the skateboard.

5. The accessory of claim 1 wherein said mounting means includes first and second plate members, and fastening means for fastening said members to the skateboard.

6. A skateboard accessory for coupling to the footboard of a skateboard, which comprises:
   - a platform member adapted to support both feet of the skateboard operator;
   - bearing means coupled to said platform member;
   - mounting means for coupling said bearing means to said footboard, said mounting means being comprised of a first plate member, first and second strap members, and fastening means for fastening said plate member to said strap members to said skateboard, said bearing means and said mounting means adapted to allow rotation of said platform members through 360° with respect to said footboard;
   - whereby said platform member is rotatable with respect to said skateboard.

7. A modified skateboard comprising:
   - a skateboard having an elongated board member to which a plurality of rollers are attached;

a platform member adapted to support both feet of the skateboard operator;

bearing means coupled to said platform member;

mounting means for coupling said bearing means to said footboard member, said mounting means being adjustable for coupling to footboards of varying thickness and width, said bearing means and said mounting means adapted to allow rotation of said platform member through 360° with respect to said footboard member;

whereby said platform member is rotatable through 360° with respect to said footboard.

8. A modified skateboard of claim 7 wherein said bearing means has a lower surface for coupling to said footboard, and an upper surface for coupling to said platform, said upper surface rotatable with respect to said lower surface about an axis.

9. The modified skateboard of claim 8 wherein said platform member is a flat disc-like member coupled to said upper surface of said bearing means, the axis of said disc-like member in general alignment with said axis of rotation of said upper bearing surface.

10. The modified skateboard of claim 7 wherein said platform member is disposed generally parallel to said footboard.

11. The modified skateboard of claim 7 wherein said mounting means includes first and second plate members, and fastening means for fastening said members to said footboard.

12. A modified skateboard comprising:

a skateboard having an elongated footboard member to which a plurality of rollers are attached;

a platform member adapted to support both feet of the skateboard operator;

bearing means coupled to said platform member;

mounting means for coupling said bearing means to said footboard member, said mounting means being comprised of a first plate member, first and second strap members, and fastening means for fastening said plate member and said strap members to the skateboard, said bearing means and said mounting means adapted to allow rotation of said platform member through 360° with respect to said footboard member;

whereby said platform member is rotatable through 360° with respect to said footboard.

13. A skateboard accessory for coupling to the footboard of a skateboard and comprising:

a platform member;

bearing means coupled to said platform member, said bearing means having a lower surface for coupling to said footboard and an upper surface for coupling to said platform;

mounting means for coupling said bearing means to such footboard, said mounting means including first and second plate members, said first plate member attached to said lower bearing surface and adapted for disposition adjacent the top surface of the footboard, and said second plate member adapted for disposition adjacent the bottom surface of the footboard, said mounting means further including fastening means for fastening said plate members to the skateboard;

whereby said platform member is rotatable with respect to the skateboard.

14. The accessory of claim 13 wherein portions of said first and second plate members overhang said footboard and said fastening means includes a plurality of fasteners extending through corresponding openings in said overlapping portions of said first and second plate members.

15. The accessory of claim 8 wherein said openings in said first and second plate members comprise slots disposed transversely to the footboard, to accommodate variations in footboard width.

16. A skateboard accessory for coupling to the footboard of a skateboard and comprising:

a platform member;

bearing means coupled to said platform member, said bearing means having a lower surface for coupling to said footboard and an upper surface for coupling to said platform;

mounting means for coupling said bearing means to such footboard, said mounting means including a first plate member attached to said lower bearing surface and adapted for disposition adjacent the top surface of the footboard, and first and second strap members adapted for disposition adjacent the bottom surface of the footboard and transverse to such footboard, said mounting means further including fastening means for fastening said plate member and said strap members to the skateboard;

whereby said platform member is rotatable with respect to the skateboard.

17. The modified skateboard comprising:

a skateboard having an elongated footboard member to which a plurality of rollers are attached;

a platform member;

bearing means coupled to said platform member, said bearing means having a lower surface for coupling to said footboard and an upper surface for coupling to said platform member;

mounting means for coupling said bearing means to such footboard, said mounting means including first and second plate members, said first plate member attached to said lower bearing surface and adapted for disposition adjacent the top surface of the footboard, and said second plate member adapted for disposition adjacent the bottom surface of the footboard, said mounting means further including fastening means for fastening said members to the skateboard;

whereby said platform member is rotatable with respect to said footboard member.

18. The modified skateboard of claim 17 wherein portions of said first and second plate members overlap said footboard and said fastening means includes a plurality of fasteners extending through corresponding openings in said overlapping portions of said first and second plate members.

19. The modified skateboard of claim 17 wherein said openings in said first and second plate members comprise slots disposed transversely to said footboard, to accommodate variations in footboard width.

20. A modified skateboard comprising:

a skateboard having an elongated footboard member to which a plurality of rollers are attached;

a platform member;

bearing means coupled to said platform member, said bearing means having a lower surface for coupling to said footboard and an upper surface for coupling to said platform;

mounting means for coupling said bearing mean to said footboard member, said mounting means including a first plate member attached to said lower bearing surface and adapted for disposition adjacent the top surface of the footboard, first and second strap members adapted for disposition adjacent the bottom surface of and transverse to such footboard, and fastening means for fastening said plate member and said strap members to the skateboard.

* * * * *